US005340000A

United States Patent [19]

Ring

[11] Patent Number: 5,340,000

[45] Date of Patent: Aug. 23, 1994

[54] VENTED PLASTIC BOTTLE

[75] Inventor: Carl D. Ring, Oakland, Tenn.

[73] Assignee: Ring Can Corporation, Oakland, Tenn.

[21] Appl. No.: 90,760

[22] Filed: Jul. 13, 1993

[51] Int. Cl.[5] ..... A47G 19/00

[52] U.S. Cl. ..... 222/468; 222/564

[58] Field of Search ..... 222/468, 479, 564, 547

[56] References Cited

U.S. PATENT DOCUMENTS

| | | | |
|---|---|---|---|
| 308,106 | 11/1884 | Stimpson . | |
| 591,735 | 10/1897 | Brewer . | |
| 767,321 | 8/1904 | Wheldon . | |
| 1,062,118 | 5/1913 | Ritten . | |
| 2,581,150 | 1/1952 | Shore | 222/525 |
| 3,066,819 | 12/1962 | Cox | 215/1 |
| 3,198,367 | 8/1965 | Stickney | 215/1 |
| 3,214,052 | 10/1965 | Dike | 215/10 |
| 3,251,514 | 5/1966 | Speicher | 222/468 |
| 3,396,875 | 8/1968 | Finch | 222/456 |
| 3,410,459 | 11/1968 | Conley | 222/479 |
| 3,434,635 | 3/1969 | Mason, Jr. | 222/468 |
| 4,412,633 | 11/1983 | Guerrazzi et al. | 222/468 |
| 4,804,119 | 2/1989 | Goodall | 222/468 |
| 4,838,464 | 6/1989 | Briggs | 222/478 |

FOREIGN PATENT DOCUMENTS 110547 12/1964 Netherlands .

OTHER PUBLICATIONS

PCT International Application No. PCT/NO85/00065, published Apr. 24, 1986, publication No. WO86/02334.

*Primary Examiner*—Gregory L. Huson

*Attorney, Agent, or Firm*—Nies, Kurz, Bergert & Tamburro

[57] ABSTRACT

A container having a novel neck arrangement including a circular spout and a guiding neck portion including a U-shaped ledge. During a pouring operation the ledge directs liquid from the container over the front edge of the spout and permits air to enter the container through the rear portion of the spout and an air passageway connecting the rear of the spout to the inside of the container.

8 Claims, 3 Drawing Sheets

VENTED PLASTIC BOTTLE

BACKGROUND OF THE INVENTION

This invention relates generally to containers for dispensing liquid and more specifically to a container having a novel pouring spout arrangement by which the space above the liquid is vented to permit air to be drawn into the space during a pouring operation to prevent the glugging or gulping phenomenon associated with many conventional bottles.

This invention is particularly applicable to blow-molded plastic jugs or bottles used for dispensing a variety of different types of liquids, some of which may be toxic or flammable. As the bottle is tipped forwardly, the mouth or neck portion will normally be lowered below the liquid level in the bottle, trapping the air in the bottle above the liquid. If no vent is provided to admit air into this region, the flow of liquid out of the bottle will alternate with the flow of air into the jug, causing a glugging or gulping action. Because of the glugging action the poured stream is difficult to control, so that the user may make a mess with the liquid. When that liquid is toxic or flammable this can create a dangerous situation.

In the past, various attempts have been made to provide containers with a vent feature to overcome this glugging problem. Typical prior proposals are illustrated in U.S. Pat. Nos. 3,251,514, 4,412,633, 4,804,119, and in PCT International Publication No. W086/02334, and those designs are improvements over the conventional bottles.

In larger blow molded plastic bottles, for example 35 pound or 5 gallon jugs, it is desirable that the neck area be both level and strong because the automatic filling and capping machines which are used to fill the jugs require a dimensionally consistent and strong neck to work efficiently. U.S. Pat. No. 5,114,028, assigned to the assignee of this application, provides a bridge top construction to maintain the level position. Applicant has discovered that it is very desirable to provide a bottle of the type illustrated in U.S. Pat. No. 5,114,028 with a spout arrangement which alleviates the glugging action during a pouring operation.

SUMMARY OF THE INVENTION

A primary object of the invention is to provide a container with a novel neck construction which eliminates glugging action as liquid is poured from the container.

Still another object of this invention resides in the provision of a container having a novel neck arrangement, including a neck and handle design which form a bridge between the front and rear walls of the container and a guiding neck portion which deflects the liquid toward the forward edge of the outlet spout of the bottle as the liquid is poured from the bottle.

Still another object of the invention resides in the provision of a container as described above wherein the outlet spout is displaced axially rearwardly of the axis of the guiding neck portion, and the rearward portion of the spout communicates with a hollow handle to permit air to freely enter into the bottle during a pouring operation.

These and other objects of the invention will become apparent from reading the following detailed description of the invention in which reference is made to the accompanying drawings wherein like numerals indicate like elements.

DETAILED DESCRIPTION OF THE INVENTION

Figure 1:
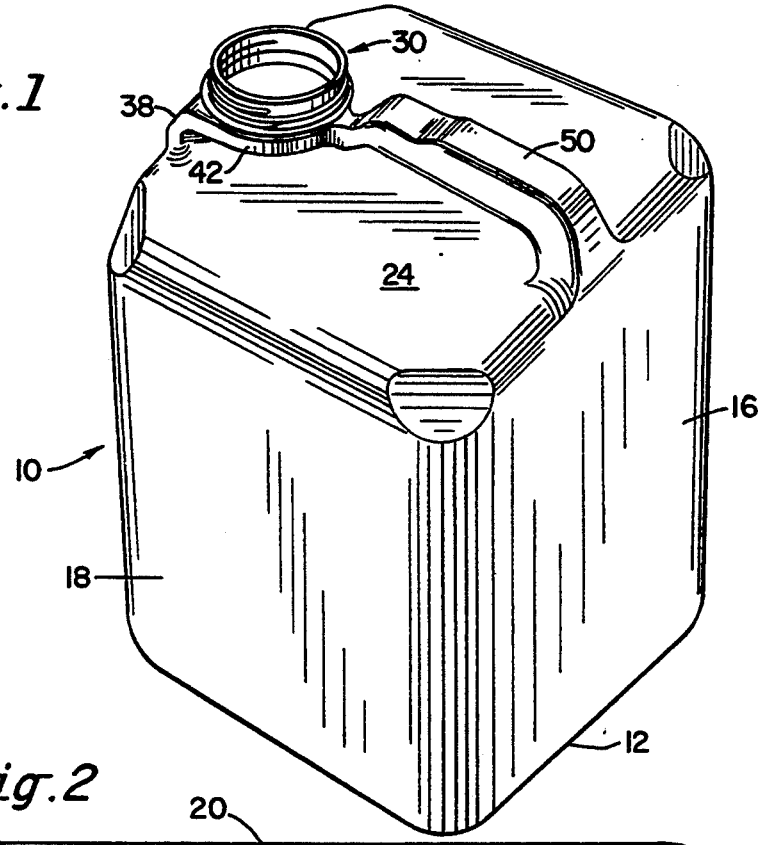
FIG. 1 is a generally perspective view of the novel blown plastic bottle of the invention.

Referring now to the drawings, the one piece blow molded plastic container or bottle 10 includes bottom wall 12, vertical front wall 14, rear wall 16, and side walls 18 and 20 which define a liquid containing chamber 22 of generally rectangular cross section and a top wall 24 joining walls 14, 16, 18, and 20 to close chamber 22.

Integrally formed on top of wall 24 adjacent front wall 14 is a neck platform 30 having a forward wall 32 including a vertical section 34 which extends along and coextensively upwardly from wall 14 and blends with a rearwardly tapered section 36 which terminates in a top wall portion 38 on which is formed a circular threaded outlet spout 40 normally closed by a cap (not shown). Platform 30 includes a pair of side walls 42 and 44 which extend rearwardly from front wall 14 generally parallel to side walls 20 and 22 to a point about the diametral line of spout 40 and then around the spout to a junction area 46 where they join with a narrow hollow handle 50 which is connected at its rearward end 52 to wall 16.

Platform 30 also includes a guiding neck portion 54 connected between and blending with top wall 24 and side walls 42 and 44. Side walls 42 and 44 define a transitional chamber 56 which extends from tapered front wall 36 to area 46 where it connects to the forward end of an air passageway 58 defined by hollow handle 50, the rearward end of passageway 58 extending through top wall 24 and communicating with chamber 22.

Figure 2:
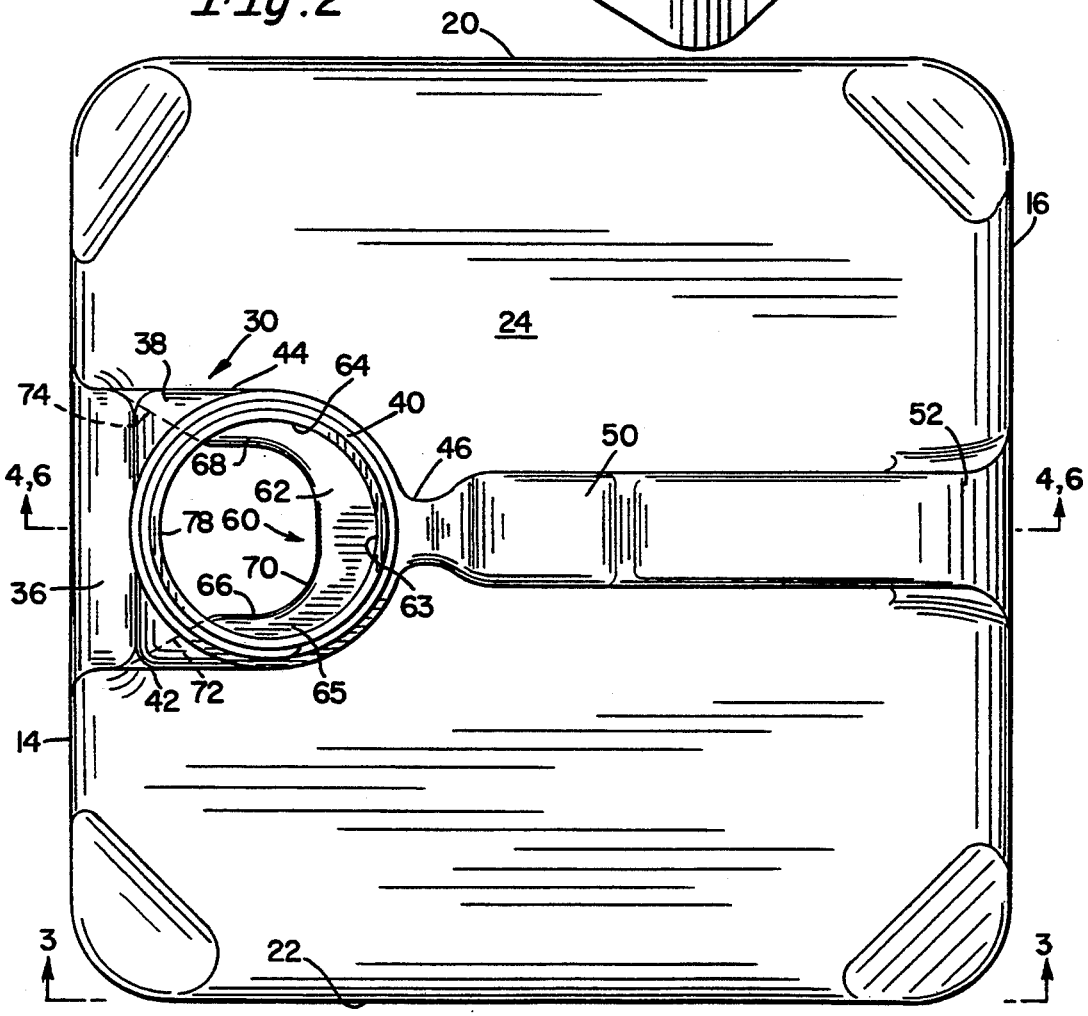
FIG. 2 is a top plan view of the bottle.
Figure 3:
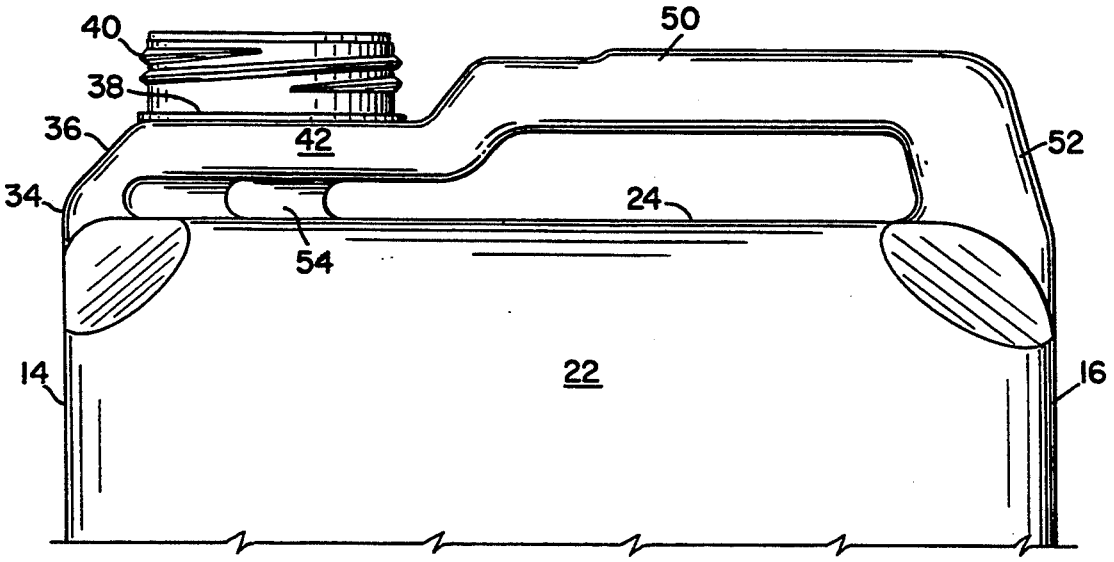
FIG. 3 is a side elevational view of the bottle taken along line 3—3 of FIG. 2.
Figure 4:
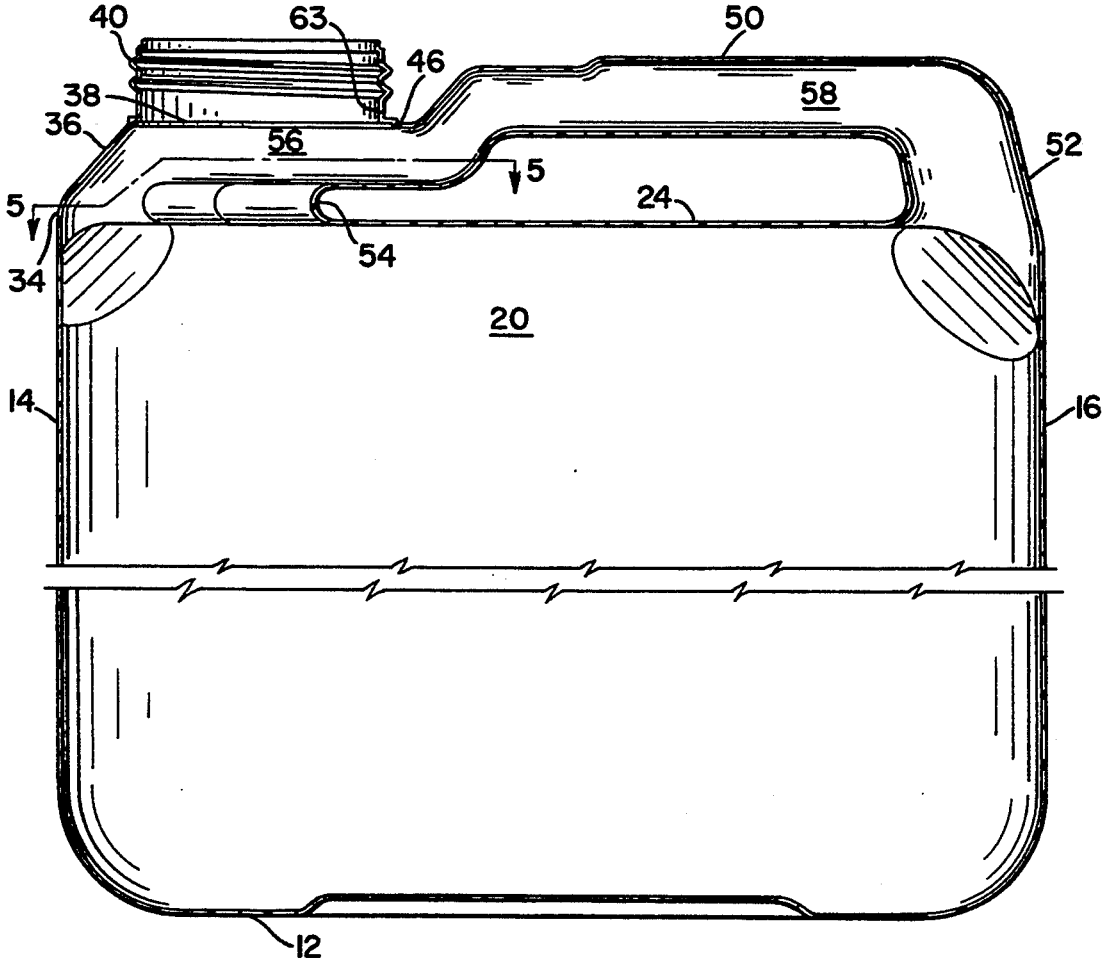
FIG. 4 is a fragmentary sectional view taken along line 4—4 of FIG. 2.
Figure 5:
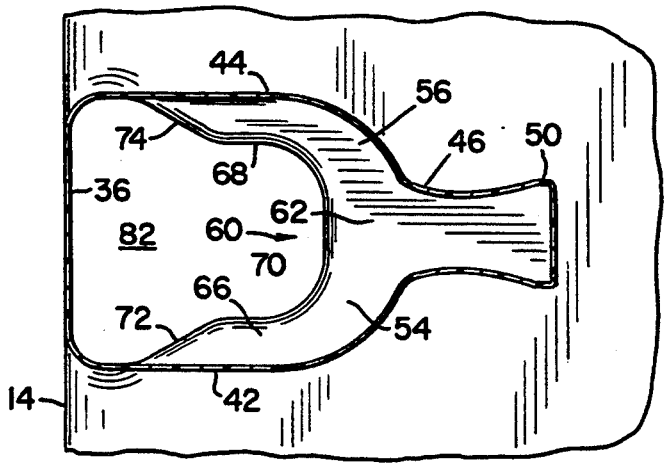
FIG. 5 is a fragmentary sectional view taken generally along line FIG. 5—5 of FIG. 4.
Figure 6:
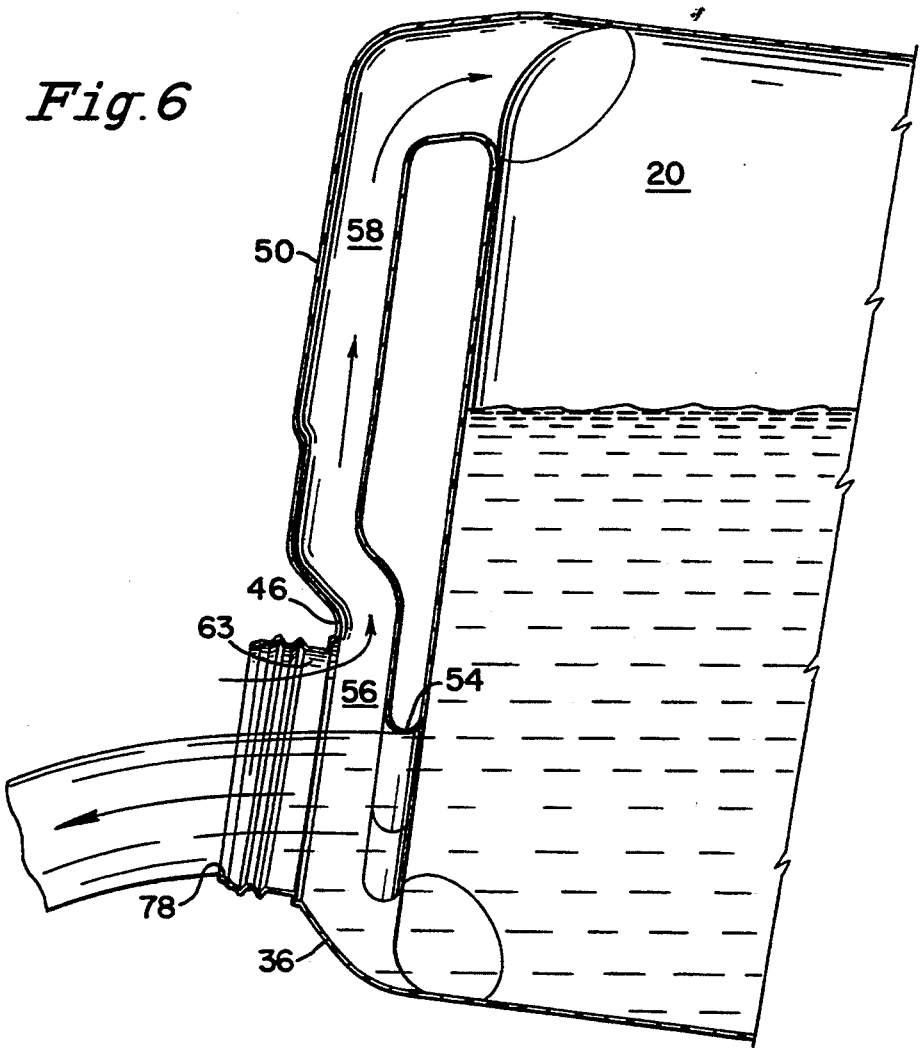
FIG. 6 is a view similar to FIG. 4, but illustrating the bottle in its tilted position in which liquid is poured from the bottle.

As seen best in FIGS. 2, 4, and 5, guiding portion 54 forms a horizontal generally U-shaped ledge 60 having a rear portion 62 extending forwardly of juncture 46 and the rear edge 63 on a diametral line of spout 40 which is parallel to side walls 20 and 22. Ledge 60 also includes side sections 66 and 68 which blend with rear section 62. The inner edge of section 62 runs generally parallel to front wall 14 and the inner edges of side sections 66 and 68 run generally parallel to walls 20 and 22. Together those inner edges form a generally U-shaped pouring edge 70 which diverges outwardly at 72 and 74 to intersect with side walls 42 and 44 adjacent the front wall 36. As shown in FIG. 2, those inner edges are spaced inwardly from the rear edge 63 and from the side edges 64 and 65 on a diametral line of spout 40 which is parallel to front wall 14 so as to deflect and guide the liquid from chamber 22 into the front portion of chamber 56 and over the front edge 78 of spout 40 away from the rear edge 63 and the side edges 64 and 65 of the spout as shown in FIG. 6. This permits air indicated by arrow 80 to enter the spout along side edges 64 and 65 and rear edge 63 into passageway 58 and into chamber 22 preventing the unwanted glugging action.

This U-shaped edge 70 diverts the liquid stream away from the sides and rear of the spout, producing a smaller area but higher velocity of liquid flow over front edge 78 and eliminating spillover over the side edges 64 and 65.

The edge 70, as it blends with the forward portions of walls 42 and 44 and tapered wall 36, forms a constrictive, directional neck area 82 which has a cross-sectional area greater than the cross-sectional area of the outlet formed by spout 40. Also, as is evident in FIG. 2, the axis of spout 40 is displaced rearwardly toward the handle from the axis of the opening defined by edge 70 and this ensures that the liquid is properly deflected, as shown in FIG. 6, to prevent any glugging action.

The construction of the platform 30 and handle 50 not only provides the desired no-glugging function, but also retains the strength referred to in U.S. Pat. No. 5,114,028 necessary to maintain the spout 40 in a level position and to resist downward deflection of the spout during the filling operation.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A plastic container comprising a bottom wall, front, rear, and side walls extending vertically from said bottom wall defining a chamber having a generally rectangular cross-section, a top wall covering a substantially portion of said chamber, a neck platform extending upwardly from said top wall adjacent said front wall and having a circular pouring spout with an open end, means connected to said platform defining an air passageway from said spout to said chamber, said platform including a guiding neck portion connected to said top wall below said spout and having a generally U-shaped horizontal ledge as viewed from the open end of said spout and opening toward said front wall, said U-shaped ledge having a rear edge which is generally parallel to said front wall and side edges extending from said rear edge toward said front wall, said rear edge and said side edges being spaced inwardly from the rear edge and side edges, respectively, of said spout, whereby during a pouring operation said U-shaped ledge directs liquid from said chamber over the front edge of said spout away from the rear edge of said spout thereby permitting air to enter the rear of said spout into said air passageway and said chamber.

2. The plastic container of claim 1, said U-shaped ledge being generally parallel to said top wall.

3. The plastic container of claim 1, wherein said means defining said air passageway is a hollow handle extending from said platform to said rear wall.

4. A plastic container comprising a bottom wall, front, rear, and side walls extending vertically from said bottom wall defining a chamber having a generally rectangular cross-section, a top wall covering a substantial portion of said chamber, a neck platform extending upwardly from said top wall and having a circuit pouring spout having a central axis and an open end, means connected to said platform defining an air passageway from said spout to said chamber, said platform including a guiding neck portion connected to said top wall below said spout and having a generally U-shaped horizontal ledge as viewed through the open end of said spout and opening toward a front edge of said spout, said U-shaped ledge having a rear edge which is generally transverse of said spout axis and side edges extending from said rear edge toward the front edge of said spout, said rear edge and said side edges of said ledge being spaced inwardly from the rear edge and side edges, respectively, of said spout, whereby during a pouring operation said U-shaped ledge directs liquid from said chamber over the front edge of said spout away from the rear edge of said spout thereby permitting air to enter the rear of said spout into said air passageway and said chamber.

5. The plastic container of claim 4, said U-shaped ledge being generally parallel to said top wall.

6. The plastic container of claim 4, wherein said means defining said air passageway is a hollow handle extending from said platform to said chamber.

7. A plastic container comprising a bottom wall, side wall means extending vertically from said bottom wall defining a chamber, a top wall covering a substantial portion of said chamber, a neck platform extending upwardly from said top wall and having a circular pouring spout having a central axis and an open end, means connected to said platform defining an air passageway from said spout to said chamber, said platform including a guiding neck portion connected to said top wall below said spout and having a generally U-shaped horizontal ledge as viewed through the open end of said spout and opening toward a front edge of said spout, said U-shaped ledge having a rear edge which is generally transverse of said spout axis and side edges extending from said rear edge toward the front edge of said spout, said rear edge and said side edges of said ledges being spaced inwardly from the rear edge and side edges, respectively, of said spout, whereby during a pouring operation said U-shaped ledge direct liquids from said chamber over the front edge of said spout away from the rear edge of said spout thereby permitting air to enter the rear of said spout into said air passageway and said chamber.

8. The plastic container of claim 7, wherein said means defining said air passageway is a hollow handle extending from said platform to said chamber.

* * * * *

UNITED STATES PATENT AND TRADEMARK OFFICE

CERTIFICATE OF CORRECTION

PATENT NO. : 5,340,000

DATED : August 23, 1994

INVENTOR(S) : Carl D. Ring

It is certified that error appears in the above-identified patent and that said Letters Patent is hereby corrected as shown below:

In column 4, line 9, delete "circuit" and insert therefor —circular—;

line 48, delete "ledges" and insert therefor --ledge—;

line 51, delete "direct" and insert therefor --directs—.

Signed and Sealed this

Eighteenth Day of October, 1994

Bruce Lehman

*Attest:*

BRUCE LEHMAN

*Attesting Officer*

*Commissioner of Patents and Trademarks*